US008591265B2

(12) United States Patent
Huang et al.

(10) Patent No.: US 8,591,265 B2
(45) Date of Patent: Nov. 26, 2013

(54) RECEPTACLE CONNECTOR

(75) Inventors: Guang-Li Huang, New Taipei (TW); Ming-Han Lin, New Taipei (TW); Li-Jun Xu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 169 days.

(21) Appl. No.: 13/343,965

(22) Filed: Jan. 5, 2012

(65) Prior Publication Data

US 2013/0178094 A1 Jul. 11, 2013

(51) Int. Cl.
*H01R 24/00* (2011.01)

(52) U.S. Cl.
USPC ..... 439/660

(58) Field of Classification Search
USPC ..... 439/660, 686, 79, 315, 489, 490, 598, 439/638, 541.5, 715, 716, 76.1, 439/607.35–607.4, 607.51–607.5, 607.24, 439/607.46, 607.47, 607.23, 607.33, 607.14
See application file for complete search history.

(56) References Cited

U.S. PATENT DOCUMENTS

| | | | | |
|---|---|---|---|---|
| 5,785,557 | A * | 7/1998 | Davis | 439/660 |
| 6,193,552 | B1 * | 2/2001 | Chiou et al. | 439/607.35 |
| 7,517,253 | B1 * | 4/2009 | Chiang | 439/660 |
| 7,744,426 | B2 * | 6/2010 | Zheng et al. | 439/660 |
| 7,857,665 | B2 * | 12/2010 | Xiong et al. | 439/660 |
| 2010/0015855 | A1 * | 1/2010 | Chiang | 439/660 |

* cited by examiner

*Primary Examiner* — Renee S Luebke
*Assistant Examiner* — Harshad Patel
(74) *Attorney, Agent, or Firm* — WPAT, P.C.; Anthony King

(57) ABSTRACT

A receptacle connector matched with a plug connector includes an insulating housing, a plurality of upper and lower terminals, a locating element and a shielding shell surrounding the insulating housing. The insulating housing defines an accommodating space, and a plurality of upper and lower terminal grooves communicating with the accommodating space. Each upper terminal disposed in the upper terminal groove has a first fastening portion, a first contact portion contacting with the plug connector, and a first soldering portion. Each lower terminal disposed in the lower terminal groove has a second fastening portion, a second contact portion contacting with the plug connector, and a second soldering portion. The locating element positioned in the accommodating space defines a plurality of through-holes aligned with the upper and lower terminal grooves respectively. The first and second soldering portions further pass through the through-holes to be soldered with a circuit board.

6 Claims, 4 Drawing Sheets

RECEPTACLE CONNECTOR

BACKGROUND OF THE INVENTION

1. Field of the Invention

The present invention generally relates to a receptacle connector, and more particularly to a receptacle connector having a multi-function performance.

2. The Related Art

With fast development of electronic industry, various electronic products are more and more frequently connected with peripherals. Connectors are widely used to connect the electronic products and the peripherals. A conventional receptacle connector disposed in a game machine includes an insulating housing, a terminal assembly received in the insulating housing and a shielding shell surrounding the insulating housing. The terminal assembly includes two signal terminals for transmitting datum, a power terminal for supplying an electrical power, and a ground terminal for connecting to ground. Currently, the rapid development of the receptacle connector calls for more stringent requirements to multi-function performance of the receptacle connector on account of a higher function and quality request of the electronic product.

However, the above-mentioned terminal assembly of the receptacle connector can only transmit the specific electrical power and datum to the electronic product. As a result, the receptacle connector has an overly monotonous function and a deficient expansion performance.

SUMMARY OF THE INVENTION

An object of the present invention is to provide a receptacle connector matched with a plug connector. The receptacle connector includes an insulating housing, a plurality of upper terminals and lower terminals, a locating element and a shielding shell. The insulating housing has a base portion and a tongue portion protruding forward from a front of the base portion. A rear of the base portion is concaved inward to define an accommodating space. The insulating housing defines a plurality of upper terminal grooves penetrating through a top of the tongue portion and an upper portion of the base portion to communicate with the accommodating space, and a plurality of lower terminal grooves penetrating through a bottom of the tongue portion and a lower portion of the base portion to communicate with the accommodating space. Each of the upper terminals has a first fastening portion disposed in the upper terminal groove. A front of the first fastening portion connects with a first contact portion projecting beyond the top of the tongue portion from a front of the upper terminal groove to electrically contact with the plug connector. A rear of the first fastening portion connects with a first soldering portion projecting into the accommodating space from a rear of the upper terminal groove. Each of lower terminals has a second fastening portion disposed in the lower terminal groove. A front of the second fastening portion connects with a second contact portion projecting under the bottom of the tongue portion from a front of the lower terminal groove to electrically contact with the plug connector. A rear of the second fastening portion connects with a second soldering portion projecting into the accommodating space from a rear of the lower terminal groove. The locating element positioned in the accommodating space defines a plurality of through-holes aligned with the upper and lower terminal grooves respectively for positioning the corresponding first and second soldering portions therein. The first soldering portions and the second soldering portions further pass through the through-holes to project behind the locating element for being soldered with a circuit board. The shielding shell surrounds the insulating housing.

As described above, the upper terminals and the lower terminals supply different voltages for the receptacle connector, enhance a ground function of the receptacle connector, and are prepared for complementing the working functions of the receptacle connector, so that make the receptacle connector have a multi-function performance and may also make an electronic product with the receptacle connector used therein expand the multiple using functions.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
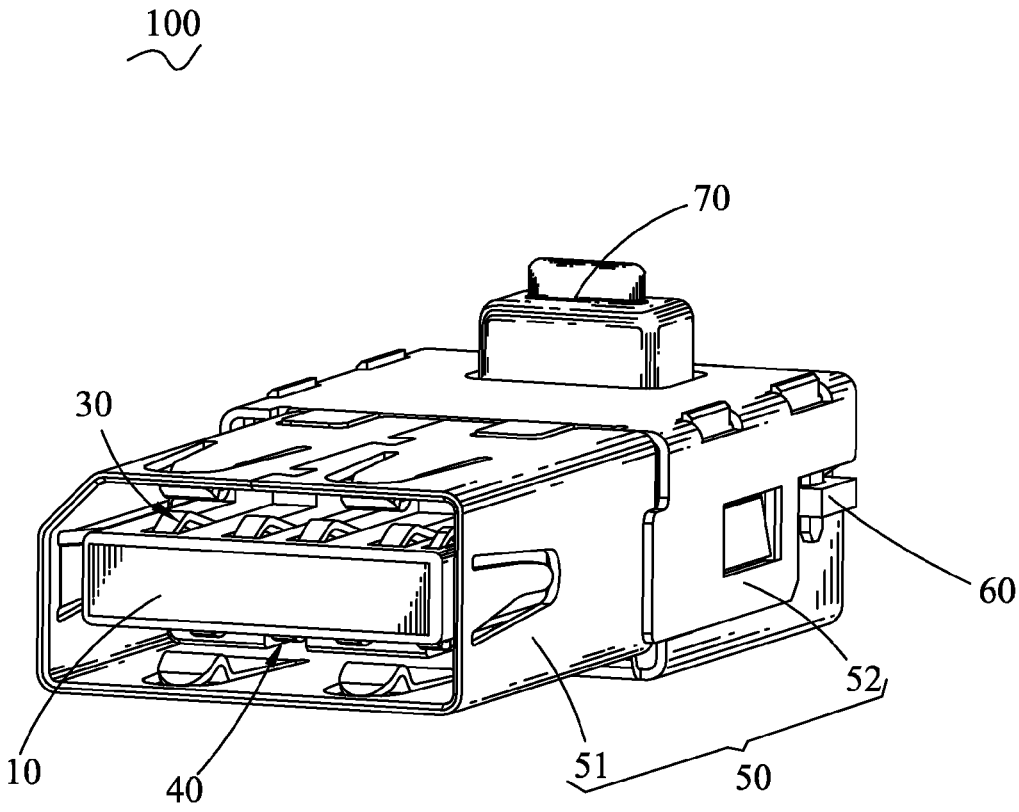
FIG. 1 is a perspective view of a receptacle connector in accordance with the present invention.
Figure 2:
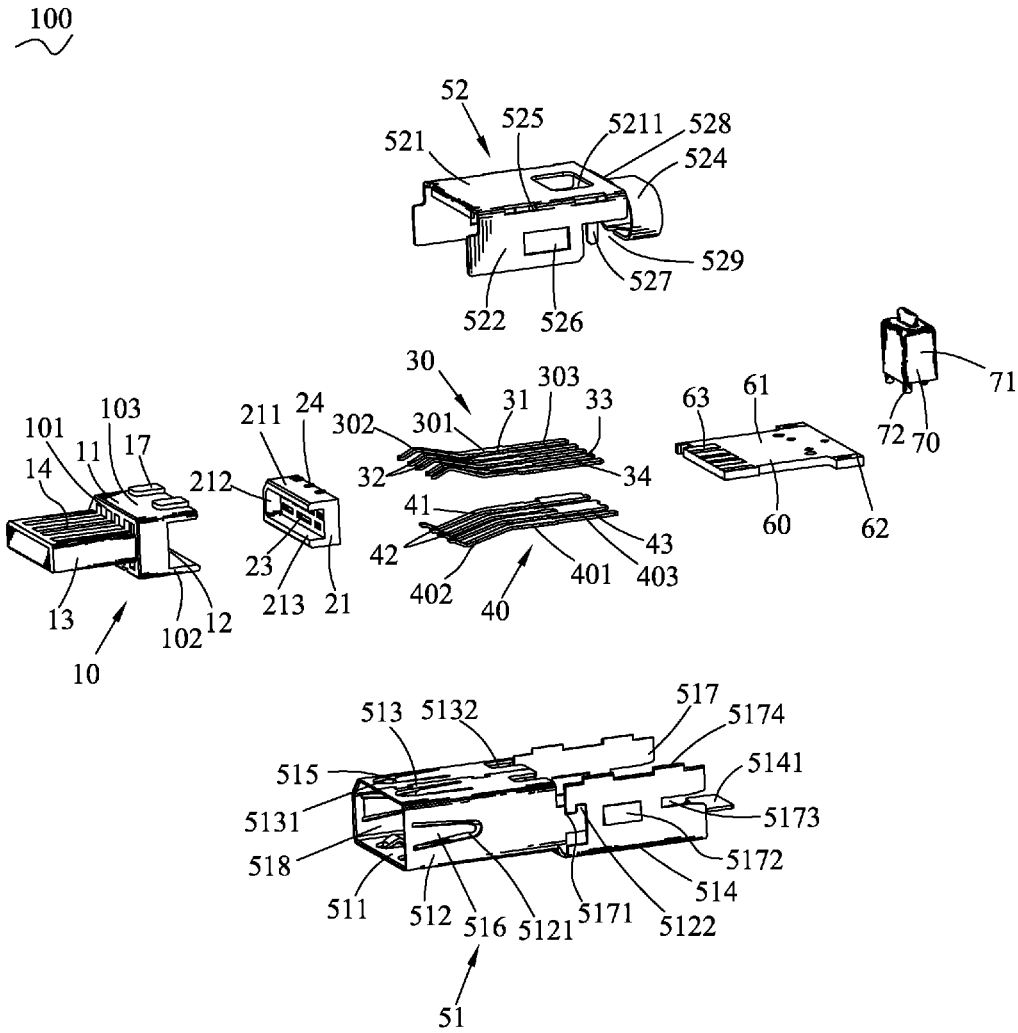
FIG. 2 is an exploded view of the receptacle connector of FIG. 1.

With reference to FIG. 1 and FIG. 2, a receptacle connector 100 in accordance with the present invention is shown. The receptacle connector 100 includes an insulating housing 10, a locating element 20, a first terminal assembly 30, a second terminal assembly 40, a shielding shell 50, a circuit board 60 and a display lamp 70.

Referring to FIG. 2, FIG. 3, FIG. 4 and FIG. 5, the insulating housing 10 has a base portion 11. The base portion 11 has a rectangular front wall 101, a top wall 103 extending rearward from a top side of the front wall 101, a bottom wall 102 extending rearward from a bottom side of the front wall 101, and an end wall 104 connecting with two ends of the bottom wall 102 and the top wall 103. An accommodating space 12 is surrounded among the front wall 101, the bottom wall 102, the top wall 103 and the end wall 104. A middle of the front wall 101 protrudes forward to form a tongue portion 13. The insulating housing 10 defines a plurality of upper terminal grooves 14 penetrating through a top of the tongue portion 13 and an upper portion of the front wall 101, and a plurality of lower terminal grooves 15 penetrating through a bottom of the tongue portion 13 and a lower portion of the front wall 101. The upper terminal grooves 14 and the lower terminal grooves 15 communicate with the accommodating space 12. Two portions of a middle of a front side of a bottom face of the bottom wall 102 are concaved inward to form two first recesses 161 spaced from each other. Two portions of a middle of a rear side of the bottom face of the bottom wall 102 are concaved inward to form two second recesses 162 respectively in alignment with the two first recesses 161. The first recess 161 is spaced from the second recess 162 to define a blocking portion 163 therebetween with a guiding surface 1631 being formed in a front of the blocking portion 163. Two portions of a top face of the top wall 103 protrude upward to form two buckling blocks 17.

Figure 3:
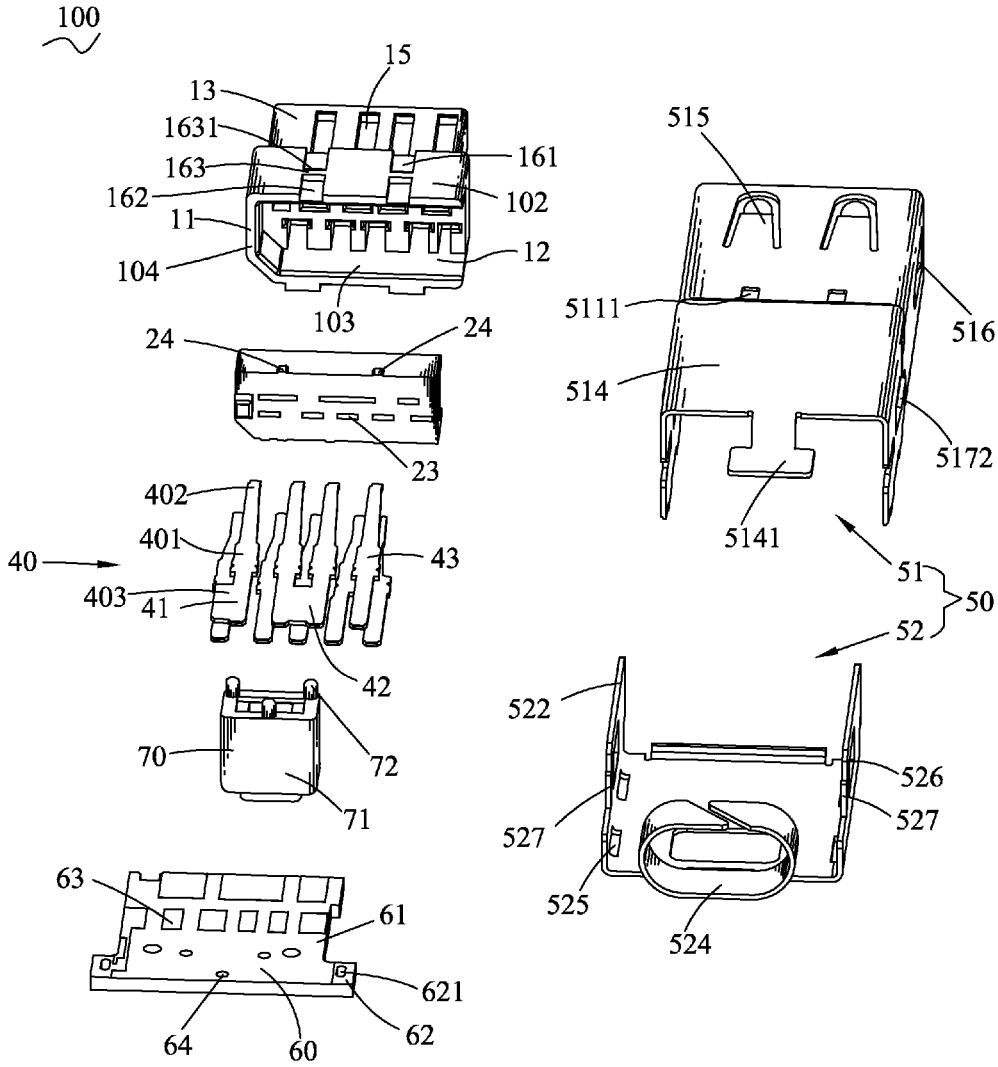
FIG. 3 is another exploded view of the receptacle connector of FIG. 1.
Figure 4:
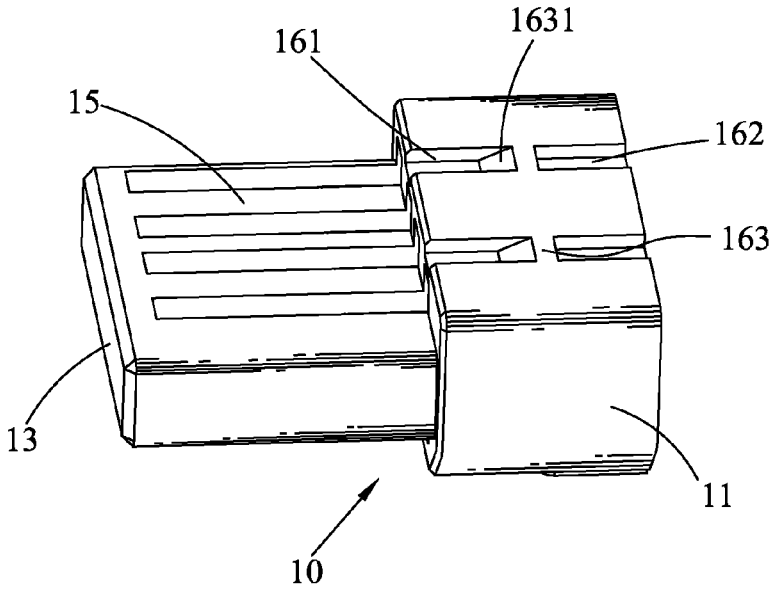
FIG. 4 is a perspective view of an insulating housing of the receptacle connector of FIG. 2.
Figure 5:
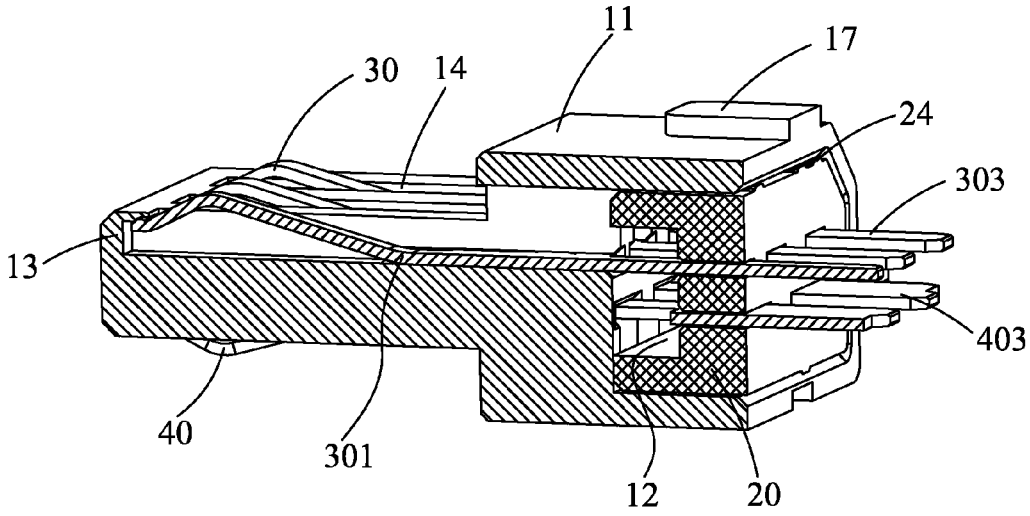
FIG. 5 is a partially sectional view of the receptacle connector of FIG. 1, showing that a locating element is assembled in the insulating housing, and a first terminal assembly and a second terminal assembly are assembled to the insulating housing with rear ends passing through the locating element.

Referring to FIG. 2, FIG. 3 and FIG. 5, the locating element 20 has a base board 21, a top board 211 extending from a top side of the base board 21, a bottom board 213 extending from a bottom side of the base board 21 and parallel to the top board 211, and a side board 212 connecting with the top board 211, the bottom board 213 and the side board 212. The base board 21 defines a plurality of rectangular through-holes 23 aligned with the upper and lower terminal grooves 14, 15 respectively. Outer surfaces of the top board 211 and the bottom board 213 respectively define a plurality of protrusions 24.

Referring to FIG. 2 and FIG. 3, the first terminal assembly 30 includes five upper terminals designated as a first power terminal 31, two signal terminals 32, a first ground terminal 33 and a second power terminal 34. Each of the upper terminals has a first fastening portion 301, a first contact portion 302 inclined upward and forward, and then arched upward from a front of the first fastening portion 301, and a first soldering portion 303 extending rearward from a rear of the first fastening portion 301. The second terminal assembly 40 includes four lower terminals designated as a third power terminal 41, two second ground terminals 42 and a standby terminal 43. Each of the lower terminals has a second fastening portion 401, a second contact portion 402 inclined downward and forward, and then arched downward from a front of the second fastening portion 401, and a second soldering portion 403 extending rearward from a rear of the second fastening portion 401.

The first power terminal 31 is used for connecting with an electrical power to supply a first voltage for the receptacle connector 100, the signal terminals 32 are used for connecting with a plug connector (not shown) to transmit datum between the receptacle connector 100 and the plug connector, and the first ground terminal 33 is used for connecting to ground so as to make the receptacle connector 100 realize a basic electrical function. Furthermore, the second power terminal 34 and the third power terminal 41 supply a second voltage and a third voltage for the receptacle connector 100, the two second ground terminals 42 together with first ground terminal 33 enhance a ground function of the receptacle connector 100, and the standby terminal 43 is prepared for complementing working functions of the receptacle connector 100. Thus, the receptacle connector 100 has a multi-function performance and may also make an electronic product (not shown) matched with the receptacle connector 100 expand multiple using functions.

Referring to FIG. 2 and FIG. 3, the shielding shell 50 includes a first shielding shell 51 and a second shielding shell 52. The first shielding shell 51 has a bottom plate 511. Two opposite sides of the bottom plate 511 extend upward to form two first side plates 512. Two top sides of the two first side plates 512 extend towards each other to form a first top plate 513. An accommodating chamber 518 is formed among the bottom plate 511, the two first side plates 512 and the first top plate 513. Two portions of a rear end of the bottom plate 511 are punched inward to form two resisting pieces 5111. The bottom plate 511 and the first top plate 513 respectively define two first openings 5131 at two fronts thereof. The first top plate 513 further defines two notches 5132 at a rear thereof. A rear inner end of each first opening 5131 extends forward and then is arched downward to form a first elastic piece 515. Each first side plate 512 defines a second opening 5121. A front inner end of each second opening 5121 extends rearward and then is arched inward to form a second elastic piece 516. The first elastic pieces 515 and the second elastic pieces 516 project into the accommodating chamber 518 to electrically contact with the plug connector matched with the receptacle connector 100. Two middles of two rear ends of the two first side plates 512 extend rearward and then extend upward to form two buckling pieces 5122. The rear end of the bottom plate 511 bends downward, and then extends rearward to form an extending plate 514. Two opposite sides of the extending plate 514 bends upward to form two bending plates 517. Each bending plate 517 defines a buckling groove 5171 at a front thereof for buckling the buckling piece 5122, a buckling portion 5172 punched outward from a substantial middle of an outer side thereof, and a slit 5173 at a rear thereof and passing through a rear end of the bending plate 517. The buckling piece 5122 is buckled in the buckling groove 5171. Two portions of a top edge of each bending plate 517 extend upward to form two insertion strips 5174 apart from each other. A middle of a rear end of the extending plate 514 is inclined upward and rearward, and then extends rearward to form a pressing plate 5141 with a rear thereof wider than a front thereof.

Referring to FIG. 2 and FIG. 3 again, the second shielding shell 52 has a second top plate 521. Two opposite sides of the second top plate 521 extends downward to form two second side plates 522. A rear end of the second top plate 521 defines a receiving hole 5211. A middle of a rear end edge of the second top plate 521 is inclined downward to form a connecting arm 528 of which a free end of the connecting arm 528 is connected with a ring-shaped resisting plate 524. A junction of each second side plate 522 and the second top plate 521 defines two insertion slots 525 penetrating therethrough. Each second side plate 522 defines a buckling hole 526. A rear of a bottom of each second side plate 522 is cut off to define a gap 529. A top inner side of the gap 529 extends downward to form a locating pin 527.

Referring to FIG. 3, the circuit board 60 has a main board 61, and two flanks 62 oppositely protruding from two rears of two opposite side edges of the main board 61. Each of the flanks 62 defines a fastening hole 621. Two fronts of a top surface and a bottom surface of the main board 61 respectively define a plurality of soldering areas 63. A rear of the main board 61 defines a plurality of insertion perforations 64. The display lamp 70 has a main body 71. A bottom of the main body 71 defines a plurality of insertion pillars 72.

Referring to FIGS. 1-5, when receptacle connector 100 is assembled, the first terminal assembly 30 are assembled to the upper terminal grooves 14 of the insulating housing 10 with the first fastening portions 301 being disposed in middles of the upper terminal grooves 14, the first contact portions 302 being disposed in fronts of the upper terminal grooves 14 and projecting beyond the top of the tongue portion 13, and the first soldering portions 303 projecting into the accommodating space 12 from rears of the upper terminal grooves 14. The second terminal assembly 40 is assembled to the lower terminal grooves 15 of the insulating housing with the second fastening portions 401 being disposed in middles of the lower terminal grooves 15, the second contact portions 402 being disposed in fronts of the lower terminal grooves 15 and projecting under the bottom of the tongue portion 13, and the second soldering portions 403 projecting into the accommodating space 12 from rears of the lower terminal grooves 15. The locating element 20 is positioned in the accommodating space 12 with the end wall 104 being attached to the side board 212, and the protrusions 24 on the top board 211 and the bottom board 213 interfering with inner faces of the bottom wall 102 and the top wall 103, respectively. The first soldering portions 303 and the second soldering portions 403 are positioned in the through-holes 23 of the locating element 20 and further pass through the through-holes 23 to project behind the locating element 20 for being soldered with the soldering areas 63 of the main board 61.

Then the shielding shell 50 surrounds the insulating housing 10. Specifically, the insulating housing 10 with the first terminal assembly 30, the second assembly 40 and the locating element 20 assembled thereto is inserted into the accommodating chamber 518 of the first shielding shell 51 from a rear to a front of the first shielding shell 51 with the two buckling blocks 17 buckled in the two notches 5132. The resisting pieces 5111 slide into the second recesses 162 through the first recesses 161 and along the guiding surfaces 1631, and is blocked in the second recesses 162 by the blocking portions 163. The first contact portions 302 and the second contact portions 402 project into the accommodating chamber 518 to electrically contact with the plug connector. The main board 61 of the circuit board 60 is inserted into an interval between the first soldering portions 303 and the second soldering portions 403 with the two flanks 62 restrained in the two slits 5173 to make the first soldering portions 303 and the second soldering portions 403 soldered with the soldering areas 63 of the main board 61 steadily. The insertion pillars 72 are inserted into the insertion perforations 64 to connect the display lamp 70 with the main board 61. At last the second shielding shell 52 is mounted to the bending plates 517 of the first shielding shell 51 with the second top plate 521 apart facing the extending plate 514 and the second side plates 522 abutting against the outer sides of the bending plates 517 respectively. A top of the main body 71 projects out from the receiving hole 5211 to display working statuses of the receptacle connector 100. The insertion strips 5174 are inserted into the two insertion slots 525 and the buckling portions 5172 are buckled in the buckling holes 526. The resisting plate 524 connects with the pressing plate 5141. The locating pins 527 are inserted into the fastening holes 621.

As described above, the first power terminal 31, the second power terminal 34 and the third power terminal 41 supply different voltages for the receptacle connector 100. The two second ground terminals 42 together with the first ground terminal 33 enhance the ground function of the receptacle connector 100. The standby terminal 43 is prepared for complementing the working functions of the receptacle connector 100. Thus, the receptacle connector 100 has the multifunction performance and may also make the electronic product with the receptacle connector 100 used therein expand the multiple using functions.

What is claimed is:

1. A receptacle connector matched with a plug connector, comprising:

an insulating housing having a base portion and a tongue portion protruding forward from a front of the base portion, a rear of the base portion being concaved inward to define an accommodating space, the insulating housing defining a plurality of upper terminal grooves penetrating through a top of the tongue portion and an upper portion of the base portion to communicate with the accommodating space, and a plurality of lower terminal grooves penetrating through a bottom of the tongue portion and a lower portion of the base portion to communicate with the accommodating space;

a plurality of upper terminals of which each has a first fastening portion disposed in the upper terminal groove, a front of the first fastening portion connecting with a first contact portion projecting beyond the top of the tongue portion from a front of the upper terminal groove to electrically contact with the plug connector, and a rear of the first fastening portion connecting with a first soldering portion projecting into the accommodating space from a rear of the upper terminal groove;

a plurality of lower terminals of which each has a second fastening portion disposed in the lower terminal groove, a front of the second fastening portion connecting with a second contact portion projecting under the bottom of the tongue portion from a front of the lower terminal groove to electrically contact with the plug connector, and a rear of the second fastening portion connecting with a second soldering portion projecting into the accommodating space from a rear of the lower terminal groove;

a locating element positioned in the accommodating space, the locating element defining a plurality of through-holes aligned with the upper and lower terminal grooves respectively for positioning the corresponding first and second soldering portions therein, the first soldering portions and the second soldering portions further passing through the through-holes to project behind the locating element for being soldered with a circuit board; and a shielding shell surrounding the insulating housing, wherein the shielding shell includes a first shielding shell having a bottom plate, two first side plates and a first top plate which are interconnected to define an accommodating chamber thereamong, the insulating housing together with the upper terminals, the lower terminals and the locating element is inserted into the accommodating chamber, wherein a bottom face of the base portion defines two first recesses at a front side thereof, and two second recesses at a rear side thereof and in alignment with the two first recesses respectively, the first recess is spaced from the second recess to define a blocking portion therebetween with a guiding surface being formed in a front thereof, two portions of a top face of the base portion protrude upward to form two buckling blocks, two portions of a rear end of the bottom plate are punched inward to form two resisting pieces sliding into the second recesses through the first recesses and along the guiding surfaces, the resisting pieces are blocked in the second recesses by the blocking portions, the first top plate defines two notches at a rear thereof for buckling the two buckling blocks.

2. The receptacle connector as claimed in claim 1, wherein the upper terminals are designated as a first power terminal, two signal terminals, a first ground terminal and a second power terminal, the first contact portion of each upper terminal is inclined upward and forward, and then arched upward from the front of the first fastening portion, and the first soldering portion extends rearward from the rear of the first fastening portion.

3. The receptacle connector as claimed in claim 1, wherein the lower terminals are designated as a third power terminal, two second ground terminals and a standby terminal, the second contact portion of each lower terminal is inclined downward and forward, and then arched downward from the front of the second fastening portion, and the second soldering portion extends rearward from the rear of the second fastening portion.

4. The receptacle connector as claimed in claim 1, wherein a rear end of the bottom plate of the first shielding shell bends downward, and then extends rearward to form an extending plate, two opposite sides of the extending plate bends upward to form two bending plates of which each defines a buckling portion on an outer side thereof, and two insertion strips apart at a top edge thereof, a rear end of the extending plate is inclined upward and rearward, and then extends rearward to form a pressing plate, the shielding shell further includes a second shielding shell having a second top plate and two second side plates, the second shielding shell is mounted to the bending plates with the second top plate apart facing the extending plate and the second side plates abutting against the outer sides of the bending plates respectively, a rear end edge of the second top plate is inclined downward to form a connecting arm of which a free end is connected with a resisting plate connecting with the pressing plate, a junction of each second side plate and the second top plate defines two insertion slots for inserting the insertion strips therein, each second side plate defines a buckling hole for buckling the buckling portion therein.

5. The receptacle connector as claimed in claim 4, wherein the circuit board has a main board and two flanks oppositely protruding from two rears of two opposite side edges of the main board, a top surface and a bottom surface of the main board respectively define a plurality of soldering areas, a rear of the bending plate defines a slit passing through a rear end of the bending plate, the main board is inserted into an interval between the first soldering portions and the second soldering portions with the two flanks restrained in the two slits to make the first soldering portions and the second soldering portions soldered on the soldering areas steadily.

6. The receptacle connector as claimed in claim 5, further comprising a display lamp, a bottom of the display lamp connecting with the circuit board, the second top plate defining a receiving hole, a top of the display lamp projecting out from the receiving hole to display working statuses of the receptacle connector.

* * * * *